US005297880A

United States Patent [19]

Kawanishi et al.

[11] Patent Number: 5,297,880

[45] Date of Patent: Mar. 29, 1994

[54] METHOD FOR SETTING AN APPARATUS HAVING A SENSOR

[75] Inventors: Hiroyuki Kawanishi; Kazuaki Ikeda; Yoichi Kimura, all of Tokyo, Japan

[73] Assignee: Seikosha Co., Ltd., Tokyo, Japan

[21] Appl. No.: 762,816

[22] Filed: Sep. 12, 1991

[30] Foreign Application Priority Data

Sep. 12, 1990 [JP] Japan ..... 2-242258

[51] Int. Cl.[5] ..... B41J 29/42

[52] U.S. Cl. ..... 400/703; 400/73; 400/76; 400/283; 400/322; 400/352; 400/705.1; 250/234

[58] Field of Search ..... 400/320, 322, 323, 279, 400/283, 352, 703, 705, 705.1, 707.2, 73, 59, 708, 76; 250/557, 560, 561, 234

[56] References Cited

U.S. PATENT DOCUMENTS

| | | | |
|---|---|---|---|
| 3,882,988 | 5/1975 | Sloan et al. | 400/320 |
| 4,112,309 | 9/1978 | Nahazawa | 250/234 |
| 4,179,223 | 12/1979 | Kwan et al. | 400/279 |
| 4,494,470 | 1/1985 | Fischer et al. | 112/121.12 |
| 4,687,352 | 8/1987 | Igi et al. | 250/234 |
| 4,881,840 | 11/1989 | Rendon et al. | 400/705.1 |
| 4,996,549 | 2/1991 | Yamaguchi | 250/561 |
| 5,052,830 | 10/1991 | Gohara | 400/76 |
| 5,076,718 | 12/1991 | Sugino | 400/283 |
| 5,135,320 | 8/1992 | Sugino | 400/279 |

FOREIGN PATENT DOCUMENTS

| | | | |
|---|---|---|---|
| 2743790 | 4/1978 | Fed. Rep. of Germany . | |
| 3216528 | 11/1983 | Fed. Rep. of Germany . | |
| 3324424 | 3/1985 | Fed. Rep. of Germany . | |
| 6782 | 1/1982 | Japan | 400/705.1 |
| 159387 | 9/1984 | Japan | 400/705.1 |
| 22977 | 1/1986 | Japan | 400/705.1 |
| 1529759 | 10/1978 | United Kingdom . | |
| 2192836 | 1/1988 | United Kingdom . | |

*Primary Examiner*—Edgar S. Burr
*Assistant Examiner*—Stephen R. Funk
*Attorney, Agent, or Firm*—Jordan and Hamburg

[57] ABSTRACT

A method for setting an apparatus, such as a printer, wherein a sensor is mounted to sense the position of a settable detection object during operation of the apparatus. The apparatus may be set as a function of the occurrence of an output from the sensor that is above or below a predetermined level at predetermined setting positions, as a function of the setting position that is close to the middle point of a range defined by adjacent positions at which the output level of the sensor rises above and falls below the predetermined level, or as a function of the position at which the highest output from the sensor is detected.

11 Claims, 6 Drawing Sheets

METHOD FOR SETTING AN APPARATUS HAVING A SENSOR

FIELD OF THE INVENTION

The present invention relates to a method for setting an apparatus, using a sensor and a detection object.

BACKGROUND OF THE INVENTION

In a printer, for example, a setting means corresponding to each of the respective printer functions, such as a dip switch and the like, is provided on the front surface panel, and the setting of the lettering font, printing start position, etc. is carried out by adjusting the setting means.

In the above-described setting method, mounting space for providing the setting means is especially necessary, and the device must be enlarged to accommodate the setting means.

SUMMARY OF THE INVENTION

The object of the present invention is to provide a setting method using a sensor which requires a simple construction but can carry out various kinds of settings.

In the present invention, the above problem is solved by setting a detection object at a desired setting position in the displacement direction of the sensor. This detection object is sensed while displacing the sensor. The desired setting is effected in response to the position of the detection object. The detection object is set at any of the setting positions including at least two positions, in the displacement direction of the sensor. The middle position of the range in which the output signal from the sensor is higher than a predetermined level may be determined and compared with the nearest respective setting positions of the detection object. In this method, the nearest setting position is considered to be the normal setting position of the detection object. Alternatively, the setting position of the largest level in the output signal levels from the sensor in respective setting positions of the detection object may be considered to be the normal position of the detection object.

The detection object may be set at a desired setting position in the displacement direction of the sensor and the displacement of the sensor accompanies displacement of the printing head of a printer. This detection object is sensed while displacing the sensor. The above-described problem is solved by setting the desired parameter of the printer as a function of the position of the detection object. The detection object is made in such a manner that it can be set at any of the setting positions, including at least two positions, in the displacement direction of the sensor. The middle point of a range, where the output signal from the sensor is above a predetermined level, and the nearest respective setting position to the middle point is determined. This nearest setting position is considered to be the normal setting position of the above-described detection object. Alternatively, the output signal levels from the sensor in the respective setting positions of the above-described detection object are sensed, and the setting position corresponding to the highest level is considered to be the normal position of the detection object.

BRIEF DESCRIPTION OF THE DRAWINGS

In order that the invention may be more clearly understood, it will now be described in greater detail with reference to the accompanying drawings, wherein:

FIG. 2(*b*) is a perspective diagram showing an essential part of the device of FIG. 2(*a*);

DESCRIPTION OF THE PREFERRED EMBODIMENTS

Figure 1:
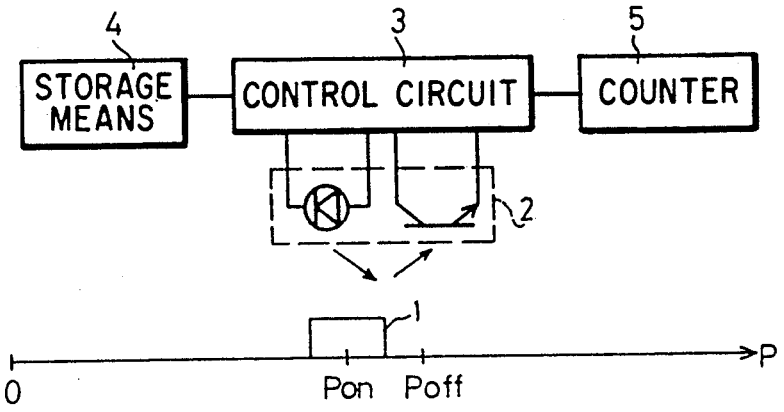
FIG. 1 is a block diagram for showing an embodiment of a printer that may be used in the practice of the present invention.

In FIG. 1, numeral 1 denotes an operating means of the slide type as a detection object having a reflection surface. Numeral 2 denotes a photosensor for generating an output signal corresponding to the amount of light it receives, 3 denotes a control circuit for controlling the operation of a printing head, and for controlling the operation of the printer corresponding to the position of the operating means 1 detected by the output signal from the photosensor 2, 4 denotes a storage means for storing the positions Pon and Poff of the operating means 1, the present position of the photosensor 2 and a reference value Vref for comparing to the output value of the photosensor 2, and 5 denotes a counter for counting pulse signals generated by the control circuit 3 when the photosensor 2 is displaced.

Figures 2A, 2B:
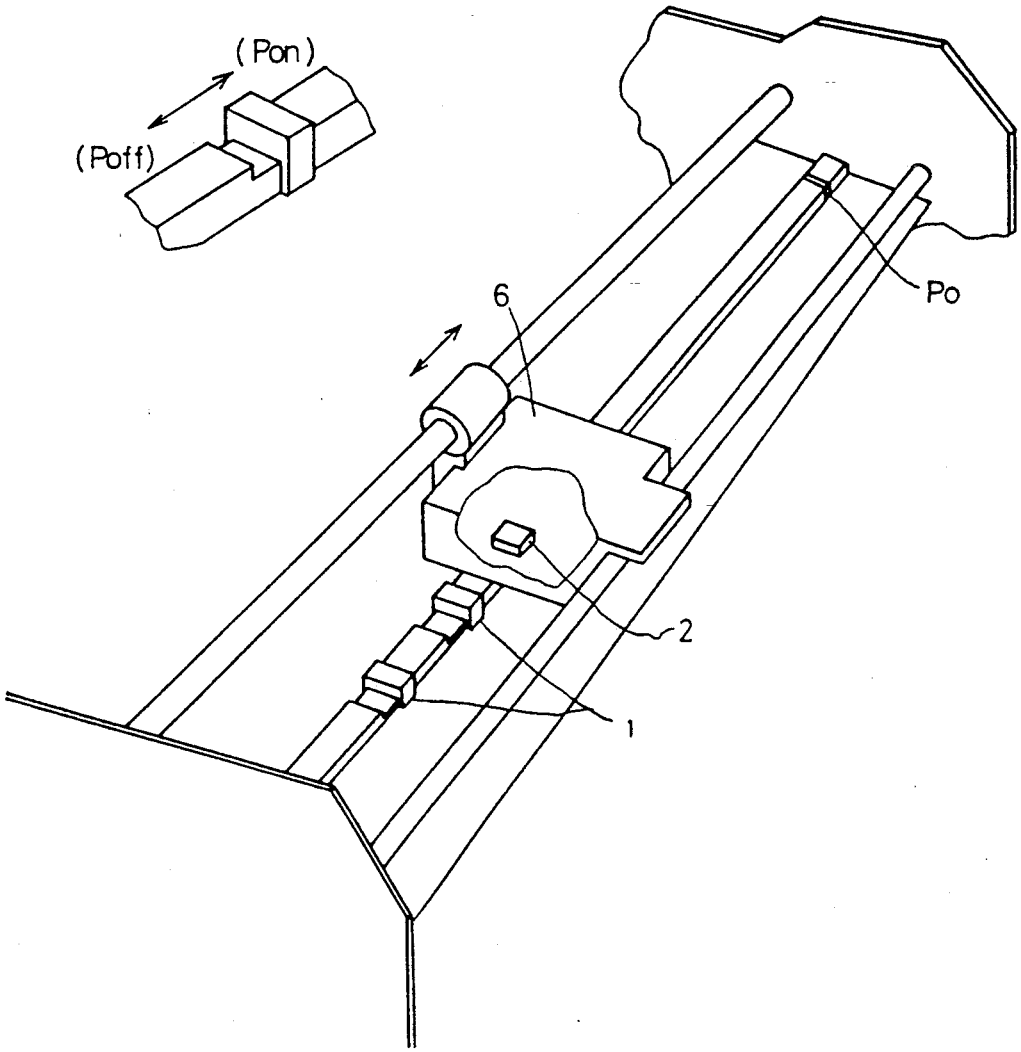
FIG. 2(*a*) is a perspective diagram of a part of the printer of FIG. 1.

FIG. 2(*a*) is a diagram showing the parts of a printer essential to the invention, the parts having the same number as those of FIG. 1 corresponding to the same component. In FIG. 2(*a*) 6 is a head carriage. The lower surface of the head carriage 6 carries the photosensor 2. The operating means 1, 1 are provided on a bar 1*a* under the head carriage 6, for setting various parameters of the printer, such as, for example, the printing quality, lettering font, printing start position, etc. The entire upper surface of the bar 1*a* is a non-reflective surface or a weak reflective surface, so that it is possible to optically discriminate its surface from the operating means. Po denotes a reflective part for home position detection use. FIG. 2(*b*) shows an enlarged view of the operating means 1 of FIG. 2(*a*). The operating means 1 slides in the displacement direction of the head carriage 6, and can be set to at least two positions, i.e., Pon and Poff. For example, high printing quality is set at the position Pon, and normal printing quality is set at the position Poff.

Figure 3:
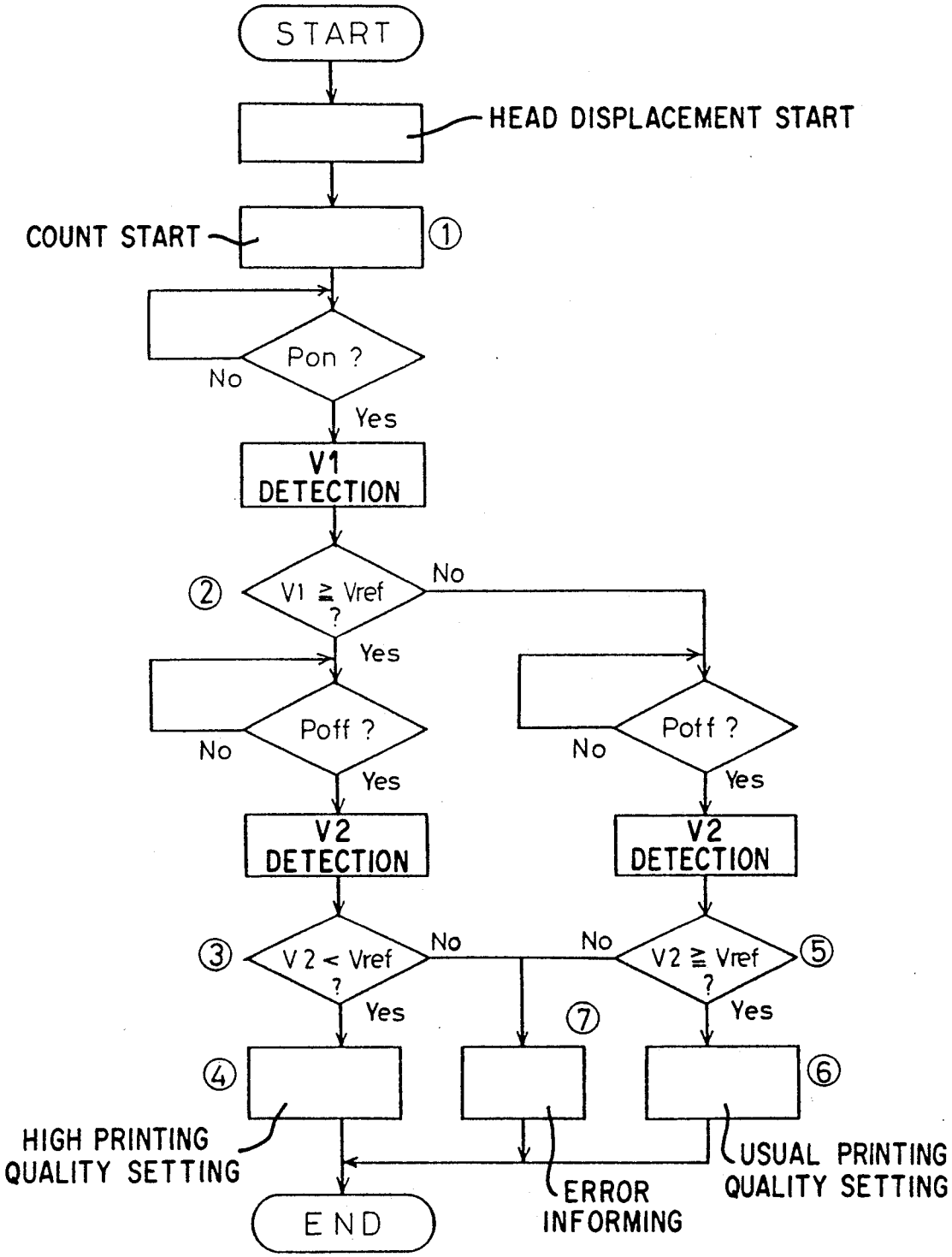
FIG. 3, FIG. 6 and FIG. 7 are flow charts for explaining the operation of the device of FIG. 1.

An explanation will now be given of the operation of the system, with reference to the flow chart of FIG. 3.

Initially, when the head carriage 6 is in the home position, the reflection part Po is detected by the photosensor 2, and the content of the counter 5 is to "0" by the detection output thereof. In accordance with the start of displacement of the head carriage 6 from the home position, a pulse signal of a constant period is generated by the control circuit 3, and this pulse number is counted by the counter 5, to detect the position of the head carriage 6 (step 1).

When the head carriage 6 has arrived at the position Pon, the output value V1 of the photosensor 2 at this position is detected, and is compared with a reference value Vref (step 2).

Figure 4:
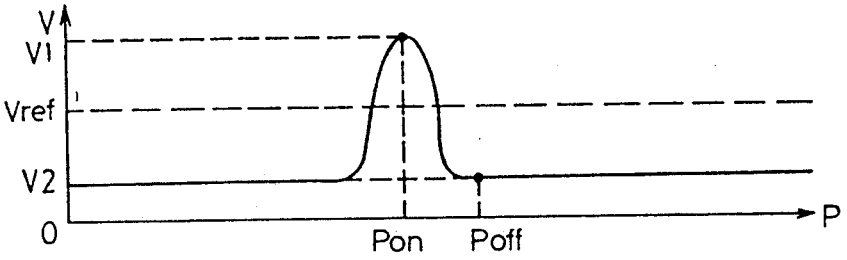
FIG. 4, FIG. 5 and FIG. 8 are explanatory diagrams for explaining the operation of the device of FIG. 1.

Assume now that the output values from the photosensor 2 at respective positions of the head carriage 6 are as shown in FIG. 4. In this case, since the output value V1 at Pon is above Vref, the output value V2 of the photosensor 2 at the time when the head carriage 6 has arrived at Poff is detected, and it is determined whether or not V2<Vref (step 3).

Now, since the output value V2 at Poff is lower than the reference value Vref, it is determined that the operating means 1 is set at the position Pon (step 4). On the basis of this determination, for example, it is ascertained that high printing quality has been set, and this fact is stored in the storage means 4.

On the other hand, when V1 is lower than Vref, the output value V2 of the photosensor 2 at the time when the head carriage 6 has come to the position Poff is detected, and it is determined whether or not V2≧Vref (step 5).

In this case, when V2≧Vref, it is determined by the control circuit 3 that the operating means 1 is set at the position Poff (step 6).

In the manner described above, various setting parameters of the printer are set by respective operating means.

Figure 5:
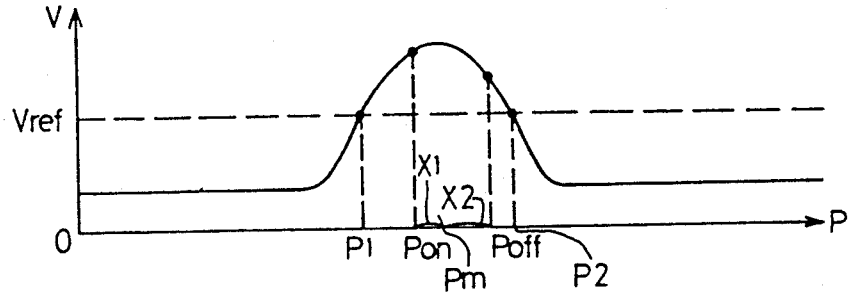

When both V1 and V2 are above Vref, and when they are both lower than Vref, an error is reported with a buzzer noise and the like that the setting state of the operating means 1 is impossible to determine (step 7). This is the case, for example,. when the rise and fall times of the output value from the photosensor 2 are slow in comparison with the displacement speed of the head carriage 6, and at any position of Pon and Poff as shown in FIG. 5, the output value from the photosensor 2 is higher than the reference value Vref. This is a case in which the setting state of the operating means 1 is impossible to determine.

Figure 6:
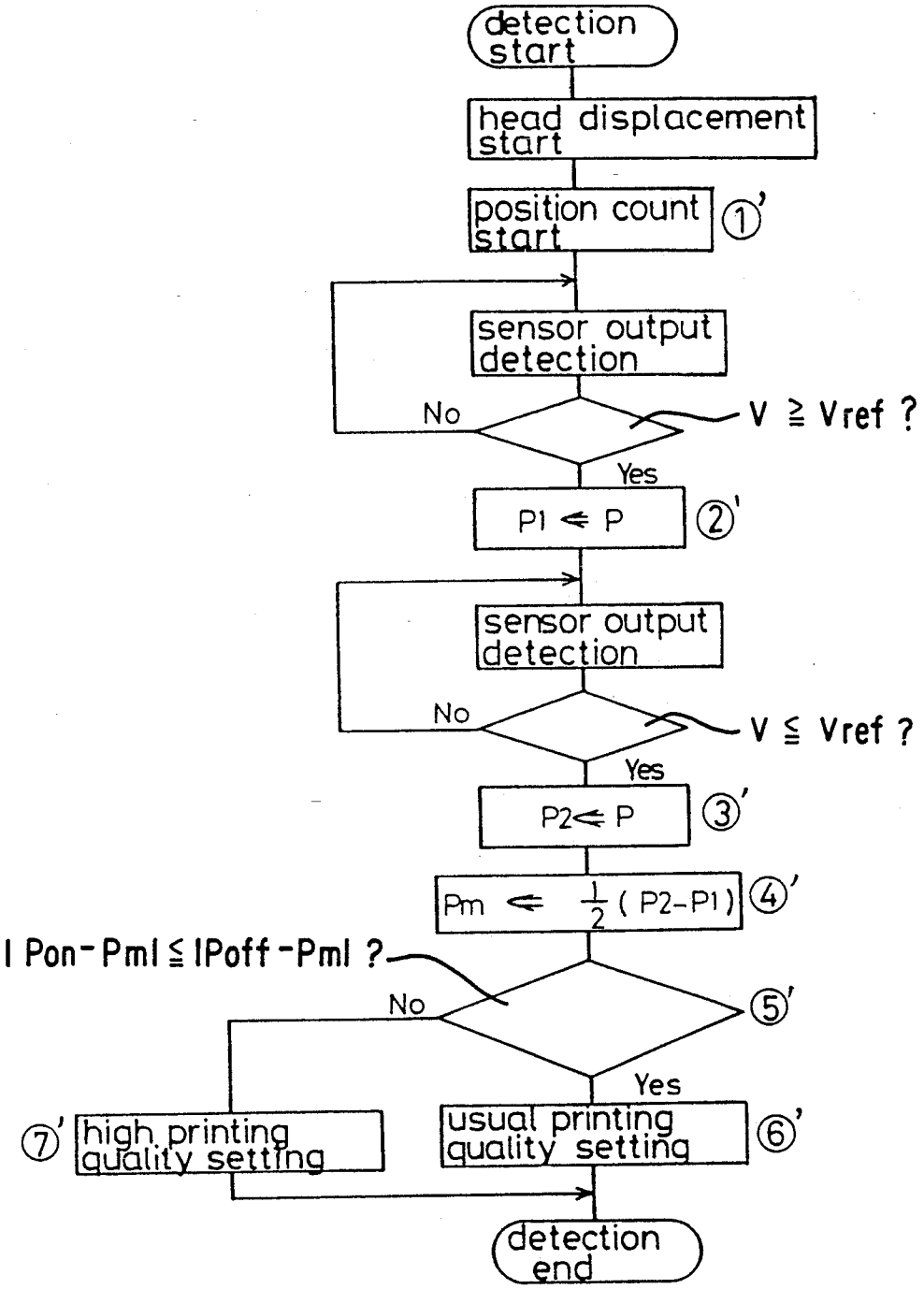

An explanation will now be given of a second embodiment of the invention, where the setting state of the operating means 1 can be determined with certainty, with reference to the flow chart of FIG. 6.

The configuration of FIG. 1 and FIGS. 2(*a*) and 2(*b*) is the same as in the first embodiment.

Initially, in the same manner as in the first embodiment at step 1, the head carriage 6 starts the displacement, and at the same time pulse signals of a constant period are generated by control circuit 3, the pulse number is counted by the counter 5, and the position of the head carriage 6 is detected (step 1').

The output values from the photosensor 2 are detected at successive respective positions, and these output values are successively compared with the reference value Vref. The position Pl of the head carriage 6, where the output value first becomes higher than Vref, is stored in the storage means 4 (step 2').

Successively, in the same manner as in step 2', the output values from the photosensor 2 at respective positions are compared with Vref, and the position P2 where the output value first becomes less than Vref after P1 is stored in the storage means 4 (step 3').

Next, the middle point Pm of P1 and P2 is calculated by the control circuit 3. That is, the calculation $$Pm=(P2-P1)/2$$

is carried out (step 4').

Next, the distance X1 from the middle point Pm to Pon $$X1=(|\ Pon-Pm\ |)$$

and the distance X2 from the middle point Pm to Poff $$X2=(|\ Poff-Pm\ |)$$

are calculated and these values are compared with one another (step 5').

Then, when X1≦X2, that is, when the middle point Pm is near to Pon, it is determined by the control circuit 3 that the operating means 1 is set at the position Pon (step 6').

On the other hand, when X1>X2, the operating means 1 is determined to be set at the position Poff (step 7').

As described above, the distance between the middle point Pm of the range where the output value from the photosensor 2 becomes higher than the reference value Vref and the predetermined positions pon and Poff are respectively detected, and the nearest one thereof is considered to be the setting position of the operating means 1.

Figure 7:
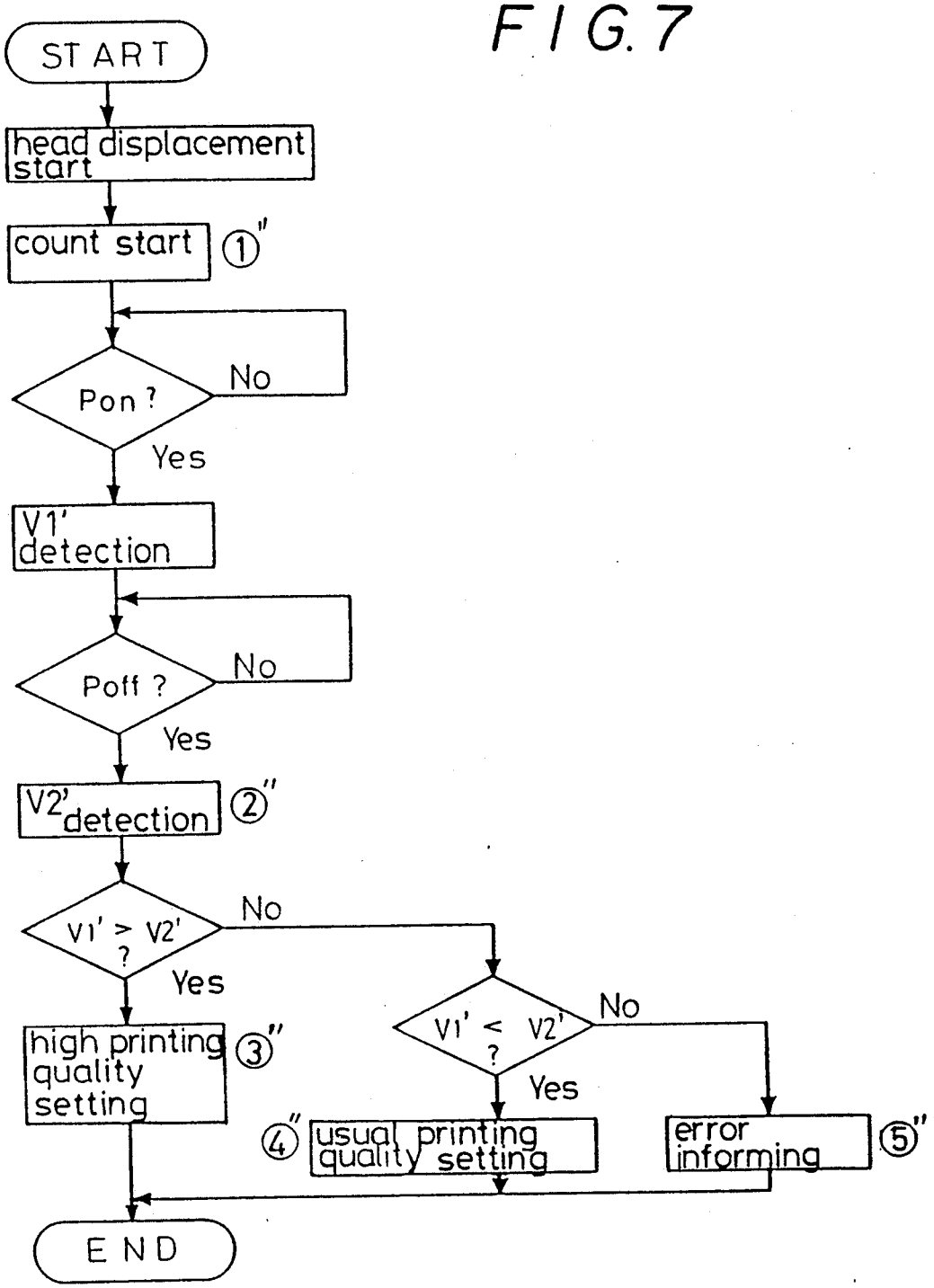

An explanation will now be given of a third embodiment of the invention which is capable of reading the setting state of the operating means 1 with certainty, with reference to the flow chart of FIG. 7.

The configuration in FIG. 1 and FIGS. 2(*a*) and 2(*b*) are the same as in the first embodiment.

Initially, in the same manner as in the first embodiment, when the head carriage 6 starts its displacement, pulse signals of a constant period are generated by the control circuit 3, the pulse number thereof is counted by the counter 5, and the position of the head carriage 6 is detected (step 1'').

When the head carriage 6 has come to the position Pon, the output value V1' of the photosensor 2 at this position is detected, and successively, when the head carriage 6 has come to the position Poff, the output value V2' from the photosensor 2 at this position is detected (step 2'').

The output values V1' and V2' are then compared, and when V1'>V2', it is determined by the control circuit 3 that the operating means 1 is set at the position Pon (step 3'').

Figure 8:
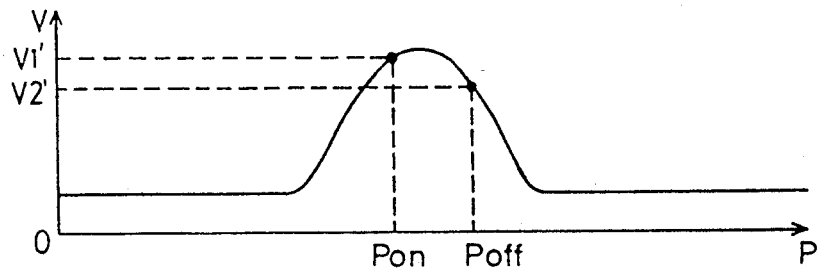

Assuming that the output values from the photosensor 2 at respective positions of the head carriage 6 are as shown in FIG. 8, since V1'>V2', it is determined that the operating means 1 is set at the position Pon.

When V1'>V2' is not true, but instead V1'<V2', it is determined by the control circuit 3 that the operating means 1 is set at the position of Poff (step 4'').

When, however, neither V1'>V2' nor V1'<V2', that is, when V1'=V2', an error is reported with the buzzer noise and the like that the setting state of the operating means 1 is impossible to determine (step 5'').

As described above, the output values from the photosensor 2 at predetermined positions Pon and Poff are detected, and the position of the larger one is read as the setting position of the operating means 1.

In the above-described respective embodiments, although the setting has been carried out by sliding the operating means 1, the invention is not so limited. For example, the setting may be carried out by sticking a tacky seal having a reflective surface at a desired position. Alternatively, a marking may be applied to the bar 1*a* with a copying means, to read the position thereof.

Although a photosensor was used in the above-described respective embodiments, the invention is not so limited. Thus, a magnetic sensor may be mounted on the printing head and a magnet may be used as the detection object. Also, an armature consisting of a conductor may be mounted on the printing head, and a contact point consisting of a conductive material provided on the bar 1*a*, to carry out the setting in correspondence with the position of the contact point to which the conduction has been applied by sliding the armature.

In the above-described respective embodiments, although the setting position of the operating means 1 has been determined to be a group of two positions Pon and Poff, the invention is not so limited, and there may be a plurality of groups having at least 2 positions, and different parameters may be set at respective setting positions. In this case the sensing means detects whether or not the detection object is at a predetermined position, for example, by the selective setting of either of 2 types of the printer to carry out the desired setting.

In the above-described second embodiment, although the middle point position Pm has been compared with the predetermined positions Pon and Poff, the middle point of Pon and Poff may be preset, and the determination of the setting state of the operating means 1 is determined by whether the middle point Pm of P1 and P2 is larger than the preset position or not.

According to the present invention, since the position of the detection object is detected with a sensor, and the setting of the printer is carried out in correspondence with the position thereof, the use of a detection object as the setting means enables an extremely simple construction. There is no need for the provision of an electric circuit for such setting means, the arrangement is simplified, and miniaturization of the device and cost reduction can be realized.

The above-described effect is enhanced in a printer by setting the sensor in such a manner that it is displaced with the head carriage, and the detection object is set in the displacement direction thereof.

According to the second and third embodiments, the setting state of the detection object can be read with certainty, even when the rise and fall times of the output values from the sensor are slow in comparison with the displacement speed of the head carriage.

Although the present invention has been fully described by way cf example with reference to the accompanying drawings, it is to be understood that various changes and modifications will be apparent to those skilled in the art. Therefore, unless otherwise such changes and modifications depart from the scope of the invention, they should be construed as being included therein.

What we claim is:

1. A function setting method for an apparatus having a sensor mounted to be displaceable in a given direction during operation of the apparatus, and a detection object having first and second different positions spaced in said direction, said detection object being selectively settable to either of said first and second different positions, said first and second positions corresponding to first and second states of a given function of said apparatus, whereby said sensor can detect the position of said detection object during displacement of said sensor, said method comprising selectively setting said detection object at one of said first and second positions, sensing each of said first and second positions to determine the presence or absence of the detection object thereat while displacing the sensor in said direction, and, in response to said sensing of said object at one of said first and second positions and the absence of said object at the other of said first and second positions:

setting the state of said function in said apparatus to the state corresponding to said one position, wherein said sensor produces an output signal in response to detection of a position of said detection object, and further comprising determining a middle point of a range defined by positions at which the output signal from said sensor rises above and falls below a predetermined amplitude, determining the output signal corresponding to the nearest one of said first and second positions to said middle point, and setting said function to the state corresponding to said nearest position.

2. A function setting method for an apparatus having a sensor mounted to be displaceable in a given direction during operation of the apparatus, and a detection object having first and second different positions spaced in said direction, said detection object being selectively settable to either of said first and second different positions, said first and second positions corresponding to first and second states of a given function of said apparatus, whereby said sensor can detect the position of said detection object during displacement of said sensor, said method comprising selectively setting said detection object at one of said first and second positions, sensing each of said first and second positions to determine the presence or absence of the detection object thereat while displacing the sensor in said direction, and, in response to said sensing of said object at one of said first and second positions and the absence of said object at the other of said first and second positions:

setting the state of said function in said apparatus to the state corresponding to said one position, wherein said sensor produces an output signal in response to detection of a position of said detection object, and further comprising determining the position of said first and second positions at which the output signals of the sensor have the highest amplitude, and setting said function to the state corresponding to the position at which said output signal has the highest amplitude.

3. A function setting method for a printer having a sensor mounted to be displaceable in a given direction during operation of a printhead of the printer, and a detection object selectively settably mounted to any of a plurality of given setting positions spaced in said direction, said setting positions corresponding to different states of a common function of said printer, said detection object being used to set a state of said function of said printer, whereby said sensor can detect the position of said detection object during displacement of said sensor, said method comprising selectively setting said detection object at a given one of said positions, sensing each of said setting positions to locate the setting position of the detection object while displacing said sensor in said direction, and, in response to sensing of said detection object at said given one of said positions:

setting said function to a state corresponding to a position at which said sensor senses said detection object, and further comprising selectively exclusively setting said detection object at one of two of said plurality of different positions.

4. The method of claim 3 comprising determining the one setting position of said two setting positions at which the sensor has an output that has a higher magnitude than at the other setting position, and setting said function to the state corresponding to said one setting position.

5. The method of claim 3 wherein said sensor produces an output signal in response to sensing a position of said detection object, comprising determining the middle point of a range at which the output signal from said sensor rises above and falls below a predetermined amplitude, determining the output signal corresponding to the nearest of said two setting positions to said middle point, and setting said function to the state corresponding to said nearest setting position.

6. A function setting method for an apparatus having a sensor mounted to be displaceable in a given direction, and a detection object selectively settable at any of a plurality of different positions spaced in said direction, said positions corresponding to different states of a given function of said apparatus, said sensor being arranged to detect the position of said detection object during displacement of said sensor, said method comprising:

setting said detection object at a given one of said positions;

sensing said plurality of said positions for the presence or absence of the detection object while displacing the sensor in said direction; and setting the state of said function to the state corresponding to the position at which said detection object is detected and disabling the state of said function corresponding to the positions other than said position at which said detection object is detected, and further comprising selectively setting said detection object at one of two different positions of said plurality of positions, wherein said sensor produces an output signal in response to detection of said detection object, and further comprising determining a middle point of a range defined by positions at which the output signal from said sensor rises above and falls below a predetermined level, determining the output signal corresponding to the nearest of said two different positions to said middle point, and setting said state to the state corresponding to said nearest setting position.

7. A function setting method for an apparatus having a sensor mounted to be displaceable in a given direction, and a detection object selectively settable at any of a plurality of different positions spaced in said direction, said positions corresponding to different states of a given function of said apparatus, said sensor being arranged to detect the position of said detection object during displacement of said sensor, said method comprising:

setting said detection object at a given one of said positions;

sensing said plurality of said positions for the presence or absence of the detection object while displacing the sensor in said direction; and setting the state of said function to the state corresponding to the position at which said detection object is detected and disabling the state of said function corresponding to the positions other than said position at which said detection object is detected, and further comprising selectively setting said detection object at one of two different positions of said plurality of positions, wherein said sensor produces an output signal in response to detection of said detection object, comprising determining the setting position at which the output signal of the sensor has the highest amplitude, and setting said state of said function to the state corresponding to said position at which the output signal has the highest amplitude.

8. A function setting method for a printer having a sensor mounted to be displaceable in a given direction during displacement of a print head, and a plurality of detection objects each of which is selectively settable to any position of a separate group of different positions spaced in said direction, said detection objects corresponding to separate functions of said apparatus and said positions of each of said groups of positions corresponding to separate states of said functions of the corresponding detection object, whereby said sensor can detect the positions of said detection objects during displacing of said sensor, said method comprising:

setting said detection objects at given positions in their respective groups of positions;

sensing all of said positions for the presence and absence of the detection objects while displacing the sensor in said direction; and setting said different functions to states corresponding to the positions at which said detection objects are sensed, wherein one of said functions comprises printing quality and said step of setting the states of different functions comprises setting printing quality.

9. A function setting method for a printer having a sensor mounted to be displaceable in a given direction during displacement of a print head, and a plurality of detection objects each of which is selectively settable to any position of a separate group of different positions spaced in said direction, said detection objects corresponding to separate functions of said apparatus and said positions of each of said groups of positions corresponding to separate states of said functions of the corresponding detection object, whereby said sensor can detect the positions of said detection objects during displacing of said sensor, said method comprising:

setting said detection objects at given positions in their respective groups of positions;

sensing all of said positions for the presence and absence of the detection objects while displacing the sensor in said direction; and setting said different functions to states corresponding to the positions at which said detection objects are sensed, wherein one of said functions comprises setting a lettering font and said step of setting different functions comprises setting a lettering font.

10. A function setting method for a printer having a sensor mounted to be displaceable in a given direction during displacement of a print head, and a plurality of detection objects each of which is selectively settable to any position of a separate group of different positions spaced in said direction, said detection objects corresponding to separate functions of said apparatus and said positions of each of said groups of positions corresponding to separate states of said functions of the corresponding detection object, whereby said sensor can detect the positions of said detection objects during displacing of said sensor, said method comprising:

setting said detection objects at given positions in their respective groups of positions;

sensing all of said positions for the presence and absence of the detection objects while displacing the sensor in said direction; and setting said different functions to states corresponding to the positions at which said detection objects are sensed, further comprising selectively setting at least one of said detection at one of two different positions of the respective group of positions, wherein said sensor produces output signals in response to detection of said detection objects, and further comprising determining a middle point of a range defined by positions at which the output signals from said sensor rise above and fall below a predetermined level, determining the output signal corresponding to the nearest of said two positions to said middle point, and setting said state of the respective function to the state corresponding to said nearest setting position.

11. A function setting method for a printer having a sensor mounted to be displaceable in a given direction during displacement of a print head, and a plurality of detection objects each of which is selectively settable to any position of a separate group of different positions spaced in said direction, said detection objects corresponding to separate functions of said apparatus and said positions of each of said groups of positions corresponding to separate states of said functions of the corresponding detection object, whereby said sensor can detect the positions of said detection objects during displacing of said sensor, said method comprising:

setting said detection objects at given positions in their respective groups of positions;

sensing all of said positions for the presence and absence of the detection objects while displacing the sensor in said direction; and setting said different functions to states corresponding to the positions at which said detection objects are sensed, further comprising selectively setting at least one of said detection objects at one of two different positions of the respective group of positions, wherein said sensor produces output signals in response to detection of said detection objects, and further comprising determining the setting position at which the output signal of the sensor has the highest magnitude, and setting said state of said function to the state corresponding to the position at which said output signal has the highest magnitude.

* * * * *